US007368672B2

(12) United States Patent
Yanai et al.

(10) Patent No.: US 7,368,672 B2
(45) Date of Patent: May 6, 2008

(54) PUSH-ON SWITCH

(75) Inventors: Yasunori Yanai, Okayama (JP); Hisashi Watanabe, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 69 days.

(21) Appl. No.: 11/497,373

(22) Filed: Aug. 2, 2006

(65) Prior Publication Data

US 2007/0039811 A1 Feb. 22, 2007

(30) Foreign Application Priority Data

Aug. 17, 2005 (JP) ..... 2005-236274

(51) Int. Cl.
*H01H 9/26* (2006.01)

(52) U.S. Cl. ..... 200/5 A; 200/512

(58) Field of Classification Search ..... 200/5 A, 200/5 R, 275, 16 R–16 D, 510–517, 406
See application file for complete search history.

(56) References Cited

U.S. PATENT DOCUMENTS 5,828,016 A * 10/1998 Grannan et al. ..... 200/16 R
5,898,147 A * 4/1999 Domzalski et al. ..... 200/1 B
6,140,596 A * 10/2000 Tsay ..... 200/406
6,271,487 B1 * 8/2001 Domzalski et al. ..... 200/1 B
6,437,682 B1 * 8/2002 Vance ..... 338/185
6,608,273 B2 * 8/2003 Watanabe et al. ..... 200/406
6,700,565 B2 * 3/2004 Niiyama ..... 345/172
6,797,906 B2 * 9/2004 Ohashi ..... 200/517
7,060,915 B2 * 6/2006 Bricaud et al. ..... 200/5 R
7,078,632 B2 * 7/2006 Komatsu ..... 200/5 R
7,102,088 B2 * 9/2006 Tan et al. ..... 200/6 A
7,145,087 B1 * 12/2006 Su et al. ..... 200/4
7,189,932 B2 * 3/2007 Kim ..... 200/5 R
7,205,491 B2 * 4/2007 Kaizu et al. ..... 200/5 A
7,259,339 B1 * 8/2007 Babella et al. ..... 200/5 A
7,288,732 B2 * 10/2007 Hashida ..... 200/5 A

FOREIGN PATENT DOCUMENTS

JP 11-232962 8/1999

* cited by examiner

*Primary Examiner*—Elvin Enad
*Assistant Examiner*—Lisa Klaus
(74) *Attorney, Agent, or Firm*—Wenderoth, Lind & Ponack, L.L.P.

(57) ABSTRACT

A push-on switch includes a movable contact which has a projecting segment permanently connected with an outer contact and which is accommodated in a recess of a switch enclosure. A sheet with a center through hole for the movable contact is placed on the switch enclosure. The push-on switch also includes a metal cover with a cover terminal. The metal cover is attached to the switch enclosure such that a pressing segment faces a disc segment of the movable contact corresponding to the position of the center through hole with a predetermined vertical gap between the pressing segment and the disc segment. When a very low and weak force is applied on the pressing segment, the pressing segment comes into contact with the disc segment to change the state of a first-stage switch.

3 Claims, 17 Drawing Sheets

PUSH-ON SWITCH

TECHNICAL FIELD

The present invention relates to a multistage push-on switch used mainly in an input operation section or the like of various electronic apparatuses, such as cameras and video camcorders.

BACKGROUND ART

One conventionally known push-on switch of this type is a dual-stage switch in which a first-stage switch turns on when the switch is lightly pressed, and then a second-stage switch turns on when the switch is more firmly pressed. Such a push-on switch is frequently used in an input operation section, such as a shutter release button of a camera or a record start button of a video camcorder.

FIG. 11 is an exterior perspective view of a conventional push-on switch. FIG. 12 is an exploded perspective view of the push-on switch of FIG. 11. FIG. 13A is a cross-sectional view taken along the line P-P shown in FIG. 11. FIG. 13B is a cross-sectional view taken along the line Q-Q shown in FIG. 11.

FIGS. 11 to 13B show substantially rectangular switch enclosure 1 that is made of resin and includes substantially circular recess 1A with an open upper side. On the inner bottom of substantially circular recess 1A, as shown in FIG. 14, which is described later, there are provided two electrically isolated peripheral contacts 2 and center contact 3 that has a slightly lower height than peripheral contacts 2. Those bare, fixed contacts are formed by insert molding.

Connection terminals 2A, 2B and 3A electrically continuous with respective fixed contacts are led out to outer sides of switch enclosure 1 and protrude therefrom. Connection terminal 6A, which is a dummy terminal, is also provided on an outer side of switch enclosure 1 and protrudes therefrom.

There are provided a pair of step-shaped movable contact receptacles 4 at opposite positions on side walls that form recess 1A. There are also provided a pair of oppositely positioned cutout grooves 5 along a line perpendicular to a center line connecting the two movable contact receptacles 4.

As shown in the plan and side views of FIGS. 15A and 15B, movable contact 7, which is formed by press working elastic sheet metal, includes spherically, upwardly curved center disc segment 8; circular ring segment 10 that is concentrically disposed outside disc segment 8 with a fixed distance therebetween; a pair of inclined connecting segments 9 that are disposed at symmetrical positions with respect to the center of movable contact 7 and that connect disc segment 8 and ring segment 10 such that disc segment 8 is higher than ring segment 10; and a pair of linearly projecting segments 11 that protrude outward from ring segment 10. Ring segment 10 is curved upward in a substantially V-shape such that two opposite positions disposed perpendicular to connecting segments 9 are two apexes 10B.

FIG. 16 is a plan view showing movable contact 7 mounted in switch enclosure 1. Projecting segments 11 are inserted in cutout grooves 5 such that the convexly curved side of movable contact 7 is oriented to project upwardly. Side sections 10A of the V-shaped bends of ring segment 10 are disposed in recess 1A of switch enclosure 1 such that they are mounted on movable contact receptacles 4, as shown in FIG. 13B.

The upper side of switch enclosure 1 is covered with flexible insulating film sheet 12, as shown in FIGS. 13A, 13B and 12. Metal cover 13 is attached to switch enclosure 1 via sheet 12. Sheet 12 is sandwiched between the lower side of metal cover 13 and the upper end face of switch enclosure 1 as well as low-profile projection 1B disposed on the upper end face of switch enclosure 1 such that projection 1B surrounds recess 1A.

As shown in FIG. 11 and other figures, metal cover 13 includes a pair of elastic arms 13B extending from flat frame-like segment 13A toward the center of metal cover 13, and center pressing segment 13C joined with flat frame-like segment 13A via elastic arms 13B. Pressing segment 13C has a substantially circular periphery and is provided with downward projection 13D at its center that protrudes downward.

The thus configured conventional push-on switch is normally of f because movable contact 7 is apart from peripheral contacts 2 and center contact 3, as shown in FIG. 13A.

The operation of the above push-on switch when it is pressed will be described with reference to cross-sectional views of FIGS. 17A, 17B, 18A and 18B. FIGS. 17A and 18A are cross-sectional views taken along the line P-P shown in FIG. 11. FIGS. 17B and 18B are cross-sectional views taken along the line Q-Q shown in FIG. 11. For clarity, these drawings only show main segments for metal cover 13.

When pressing segment 13C of metal cover 13 is lightly pushed from above, pressing segment 13C moves downward and downward projection 13D presses disc segment 8 of movable contact 7 via sheet 12. When the pressing force exceeds a predetermined value, as shown in FIGS. 17A and 17B, ring segment 10 of movable contact 7, supported by the portions of ring segment 10 placed on movable contact receptacles 4, provides a moderate click feeling as it changes from the convex shape to a concave shape while disc segment 8 keeps its spherical shape. At this point, disc segment-side base parts of two connecting segments 9 come into contact with two electrically isolated peripheral contacts 2, respectively. This first-stage action turns the first-stage switch on where two peripheral contacts 2, that is, connection terminals 2A and 2B (see FIG. 16) become electrically continuous with each other via movable contact 7.

When pressing segment 13C is further pushed downward from this state to push disc segment 8 of movable contact 7 downward via sheet 12, disc segment 8, which is now supported by its periphery placed on peripheral contacts 2, provides a moderate click feeling as it changes from the convex shape to a downward concave shape, as shown in FIGS. 18A and 18B, and the center lower side of disc segment 8 comes into contact with center contact 3. This second-stage action turns the second-stage switch on where center contact 3 as well as two peripheral contacts 2, which were already short-circuited when the first-stage switch was turned on, that is, connection terminal 3A as well as connection terminals 2A and 2B (see FIG. 16) become electrically continuous with each other.

Thereafter, when the pushing force on pressing segment 13C is removed, the pressing force on disc segment 8 of movable contact 7 is removed and disc segment 8 first restores its upward protruding spherical shape due to its elastic restoring force. Consequently, the center lower side of disc segment 8 separates from center contact 3 and the second-stage switch returns to its off-state, followed by the movement of connecting segments 9 returning to their inclined state in which their disc segment 8 side sections become higher than the other side. At the same time, disc segment-side parts of the connecting segments 9 separate from peripheral contacts 2 and the first-stage switch also returns to its off-state. When movable contact 7 is restored to its original shape, sheet 12 as well as elastic arms 13B joined with pressing segment 13C return to their original positions.

FIG. 19 shows the relationship between the travel in each operation described above and the timing of when the switch at each stage turns on.

Such a conventional push-on switch is equipped as a switch of a shutter release section of a digital still camera, for example, and an on-signal supplied from the first-stage switch by a light press operation activates focus adjustment for a subject. Another on-signal supplied from the second-stage switch by a firmer press operation fires the shutter.

A known related art document associated with the invention of this application is, for example, Japanese Patent Unexamined Publication No. 1999-232962.

The above-mentioned conventional push-on switch is equipped, for example, in shutter release sections of various cameras. On the other hand, as digital still cameras and video camcorders become commonplace, such cameras themselves have been modified in various ways and provided with enhanced functionality and user friendly features.

Under the current situation in which cameras with an anti-handshake function are especially well accepted in the market, when the above-mentioned conventional push-on switch is used as a shutter release button or a record start button of such a camera with an anti-handshake function, the on-signal from the first-stage switch activates the anti-handshake function as well as focus adjustment. To keep these functions activated, after the first moderate click feeling of the switch is provided, this pressed state must be retained. In this case, a relatively low operation force is sufficient to keep the first-stage switch on. However, when taking pictures while the user is moving, problems arise. For example, the finger may slightly come off the operation button or the above activated state may undesirably be released. Therefore, there is a desire to achieve a push-on switch that overcomes such problems.

SUMMARY OF THE INVENTION

The invention overcomes such problems associated with the related art and provides a multistage push-on switch in which a first-stage switch turns on with an operation force lower than conventionally achievable and the resultant on-state is easily retained.

A push-on switch according to the invention includes:

(a) a switch enclosure made of insulating resin;

(b) a movable contact made of elastic sheet metal that is disposed in a recess of the switch enclosure made of insulating resin;

(c) a sheet that is disposed to cover the recess of the switch enclosure made of insulating resin, the sheet having a center through hole; and (d) a metal cover attached to the insulating switch enclosure, the metal cover having a cover terminal and a pressing segment at a position corresponding to the position of the center through hole of the sheet.

The switch enclosure made of insulating resin (a) includes:

(a1) a center contact and two peripheral contacts disposed equidistantly therefrom disposed on the inner bottom of the recess with an open upper side; and (a2) at least one outer contact outside the peripheral contacts.

The movable contact (b) includes:

(b1) a disc segment with a spherically curved upper surface and a periphery disposed above the peripheral contacts with a predetermined gap therebetween;

(b2) an outer ring segment that is concentrically joined with the disc segment by a flexible connecting segment with a fixed distance between the ring segment and the disc segment, the ring segment mounted on a step-shaped movable contact receptacle provided in the recess of the switch enclosure; and (b3) a projecting segment that protrudes outward from the ring segment, (b4) the projecting segment permanently connected with the outer contact (a2).

With such a configuration, the pressing segment of the metal cover may be pressed downward and comes into contact with the disc segment of the movable contact to turn a first-stage switch on, and a force required to move the pressing segment may be lower than conventionally required.

When the pressing segment in the above state is further pressed with a low operation force, the movable contact comes into contact with the peripheral contacts to turn a second-stage switch on where the peripheral contacts are electrically continuous with each other. Subsequent firmer pressing operation causes the disc segment of the movable contact to be inverted in shape to turn a third-stage switch on where the movable contact also comes into contact with the center contact.

The outer contact of the push-on switch according to the invention is electrically continuous with one of the peripheral contacts, so that the first-stage switch is always on when the second-stage switch turns on.

The push-on switch according to the invention is configured such that the lower side of the sheet around the center through hole is adhesively held over a circular ring portion of the disc segment of the movable contact, resulting in highly dustproof construction.

As described above, the invention can provide a multistage push-on switch in which a first-stage switch turns on with an operation force lower than conventionally achievable and the resultant on-state is easily retained.

DETAILED DESCRIPTION OF THE INVENTION

An embodiment of the invention will be described with reference to the drawings. Structures similar to those in the example of the related art have the same numerals or signs and detailed descriptions thereof will be omitted.

Embodiment

Figure 1:
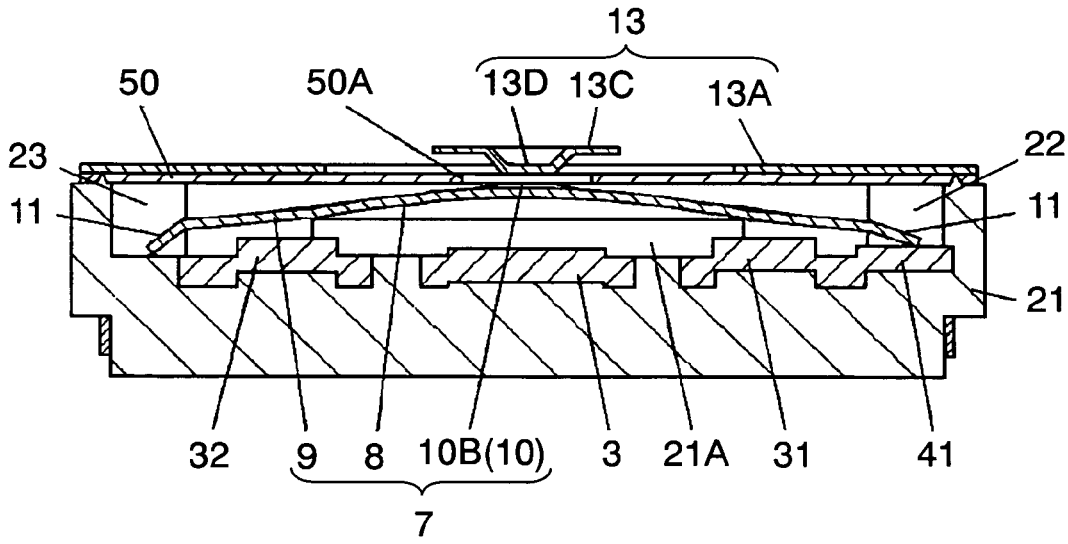
FIG. 1 is a cross-sectional view of a push-on switch according to the invention.
Figure 2:
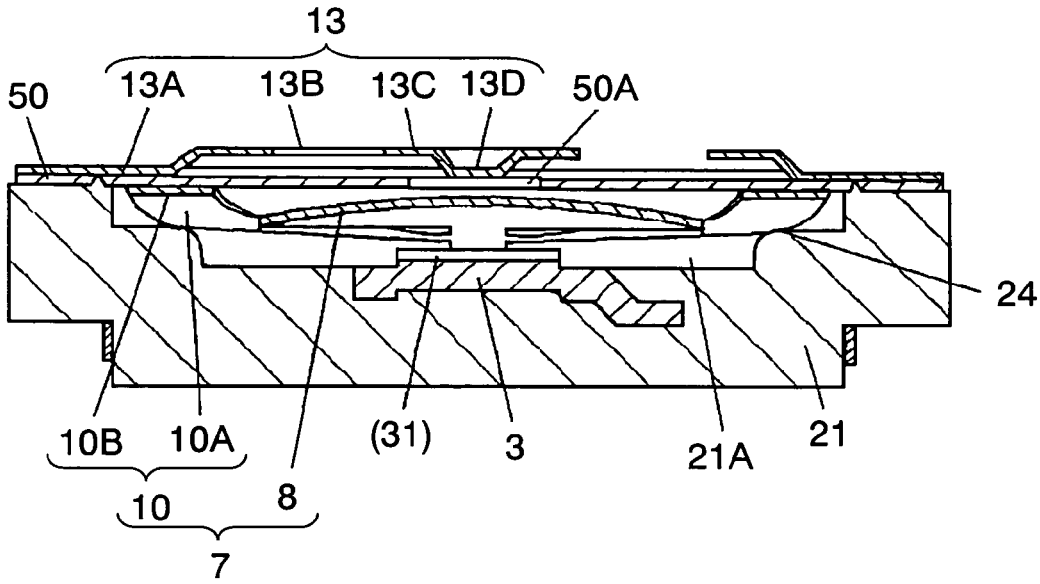
FIG. 2 is another cross-sectional view of the push-on switch according to the invention.
Figure 3:
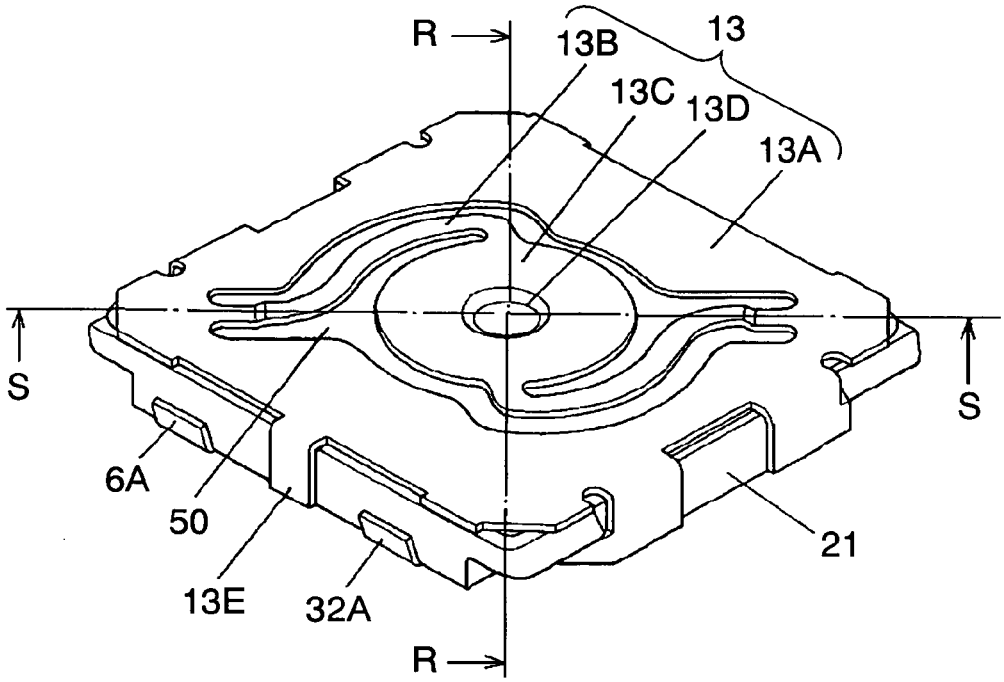
FIG. 3 is an exterior perspective view of the push-on switch according to the invention.
Figure 4:
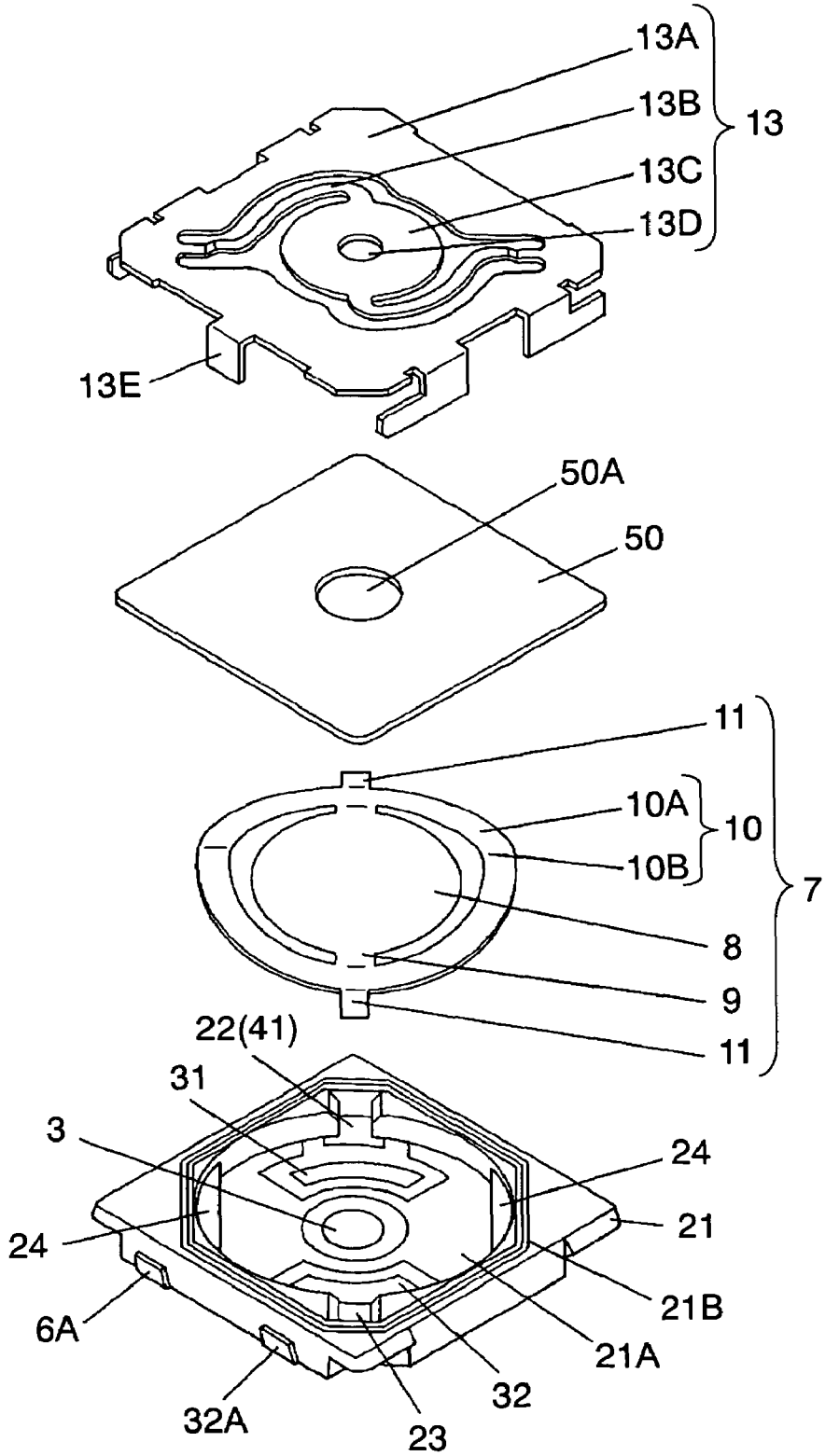
FIG. 4 is an exploded perspective view of the push-on switch according to the invention.

FIGS. 1 and 2 are cross-sectional views of the push-on switch according to one embodiment of the invention. FIG. 3 is an exterior perspective view of the push-on switch of FIGS. 1 and 2. FIG. 4 is an exploded perspective view of the push-on switch of FIGS. 1 and 2. FIG. 1 is a cross-sectional view taken along the line R-R shown in FIG. 3. FIG. 2 is a cross-sectional view taken along the line S-S shown in FIG. 3.

In FIGS. 1 to 3, substantially rectangular switch enclosure 21, which is made of resin, has substantially circular recess 21A with an open upper side. Substantially circular recess 21A has cutout grooves 22 and 23 at corners of switch enclosure 21. In recess 21A, there are also provided a pair of step-shaped movable contact receptacles 24 disposed at right angles with respect to cutout grooves 22 and 23.

Fixed center contact 3 is formed by insert molding at the center position on the inner bottom of recess 21A. Two electrically isolated peripheral contacts 31 and 32 are disposed equidistantly from center contact 3 on the periphery of recess 21A. Those bare, fixed contacts are formed by insert molding. The height difference between peripheral contacts 31, 32 and center contact 3 is the same as that of the example of the related art.

Peripheral contact 31 is routed toward cutout groove 22 and forms the bottom of cutout groove 22. The bottom of cutout groove 22 protrudes upward from the inner bottom of recess 21A and outer contact 41 is formed on the bottom of cutout groove 22.

Other peripheral contact 32 is routed away from the bottom of cutout groove 23 and embedded in switch enclosure 21.

Connection terminal 3A, which is electrically continuous with center contact 3, is led out to an outer side of switch enclosure 21 and protrudes therefrom. Connection terminal 31A, which is electrically continuous with peripheral contact 31 and outer contact 41, as well as connection terminal 32A, which is electrically continuous with peripheral contact 32 are also independently led out to outer sides of switch enclosure 21 and protrude therefrom. There is also provided connection terminal 6A as a dummy terminal.

Movable contact 7 is accommodated in recess 21A. Movable contact 7 has projecting segments 11 linearly protruding therefrom and slightly bent downward at a predetermined angle.

Projecting segments 11 of movable contact 7 are inserted in cutout grooves 22 and 23 such that the convexly curved side of center disc segment 8 as well as apexes 10B of the V-shaped bends of circular ring segment 10 that is concentrically joined with the periphery of center disc segment 8 project upwardly. Side sections 10A of the V-shaped bends of ring segment 10 are disposed in recess 21A of switch enclosure 21 such that they are mounted on movable contact receptacles 24, as shown in FIG. 2.

The lower end of one of projecting segments 11 inserted in cutout groove 22 is permanently connected with outer contact 41 that forms the bottom of cutout groove 22. The lower end of the other projecting segment 11 inserted in cutout groove 23 also abuts the bottom of cutout groove 23. Alternatively, the other projecting segment 11 may be disposed at a slightly different height relative to the one of projecting segments 11 and hence faces off against cutout groove 23.

Figure 5:
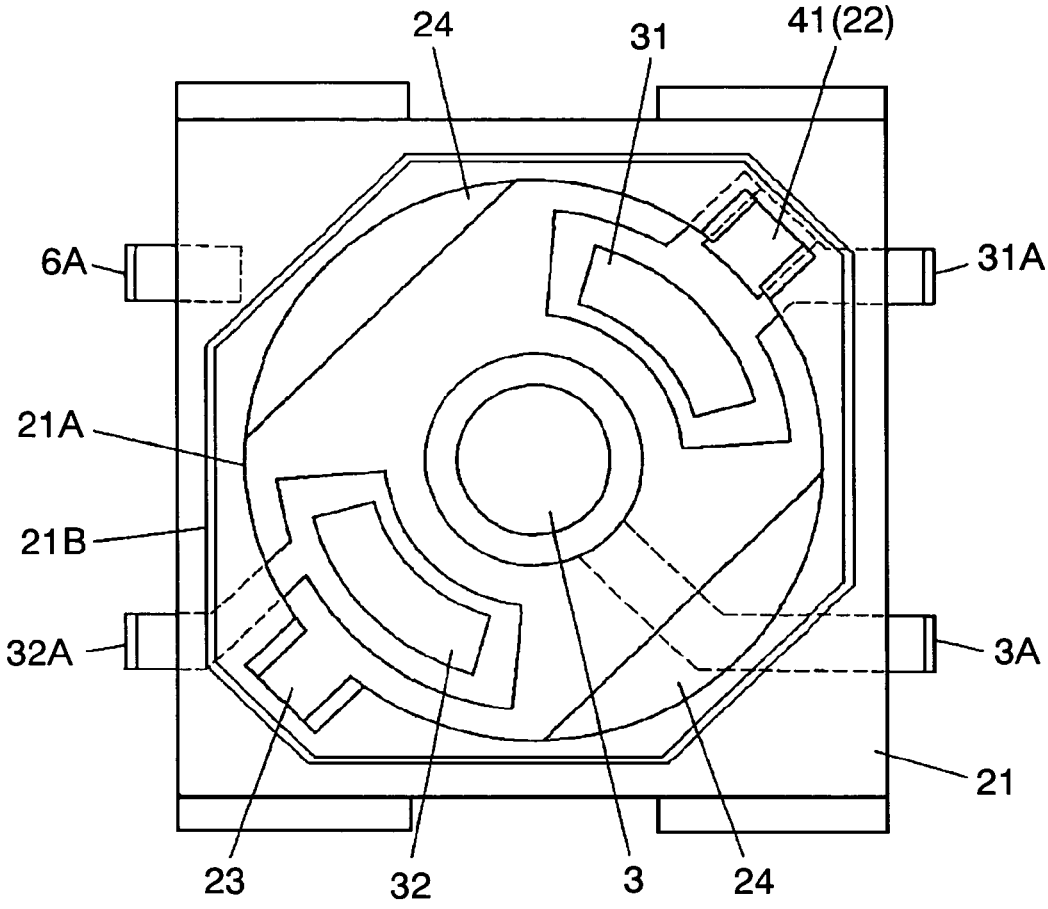
FIG. 5 is a plan view of a switch enclosure according to the invention.

Elastic sheet 50 made of rubber or insulating film has circular center through hole 50A smaller than disc segment 8 of movable contact 7. The center of center through hole 50A is located at the center of disc segment 8, and the periphery of sheet 50 is sandwiched between the lower side of flat frame-like segment 13A of metal cover 13 and the upper end face of switch enclosure 21 as well as low-profile projection 21B disposed on the upper end face of switch enclosure 21 such that projection 21B surrounds recess 21A (see FIGS. 4 and 5). The lower side of sheet 50 around center through hole 50A is adhesively held over the circular ring portion of disc segment 8, resulting in highly dustproof construction. The periphery of sheet 50 may be adhesively held on the upper end face of switch enclosure 21.

Metal cover 13 is provided with cover terminal 13E as a so-called ground terminal. Other components of metal cover 13 are the same as those of the example of the related art. Thus, as in movable contact 7, the following description will be given with the same numerals and signs of the components of metal cover 13 as those of the example of the related art and descriptions of detailed configurations thereof will be omitted.

A pressing segment 13C formed in metal cover 13 has downward projection 13D, the lower side of which faces the apex of disc segment 8 corresponding to the position of center through hole 50A with a predetermined vertical gap between projection 13D and the apex of disc segment 8. Center through hole 50A is larger than downward projection 13D.

The operation of the thus configured push-on switch according to the invention will be described below.

As shown in FIGS. 1 and 2, the push-on switch is normally off. In this state, movable contact 7 is only in contact with outer contact 41 but neither with center contact 3 nor peripheral contacts 31, 32.

Figure 6A:
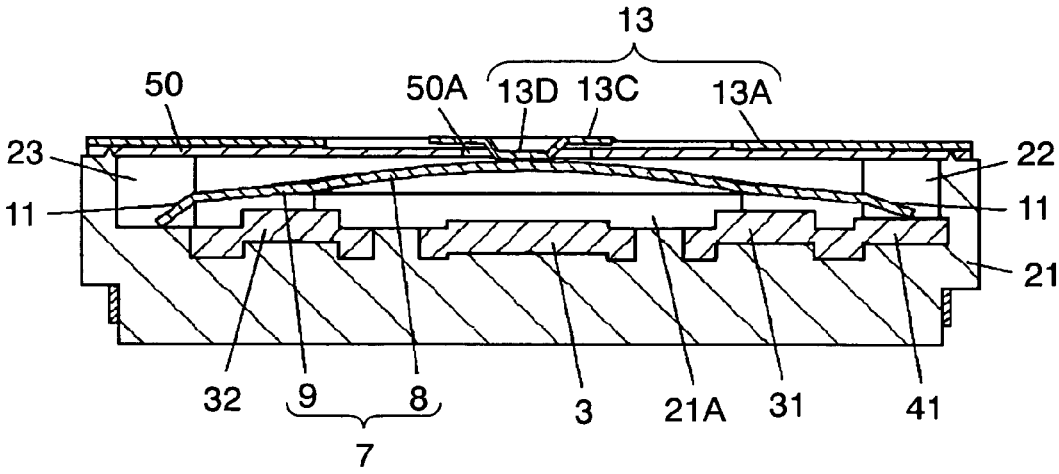
FIG. 6A is a cross-sectional view taken along the line R-R shown in FIG. 3 for explaining the operation of a first-stage switch of the push-on switch according to the invention.
Figure 6B:
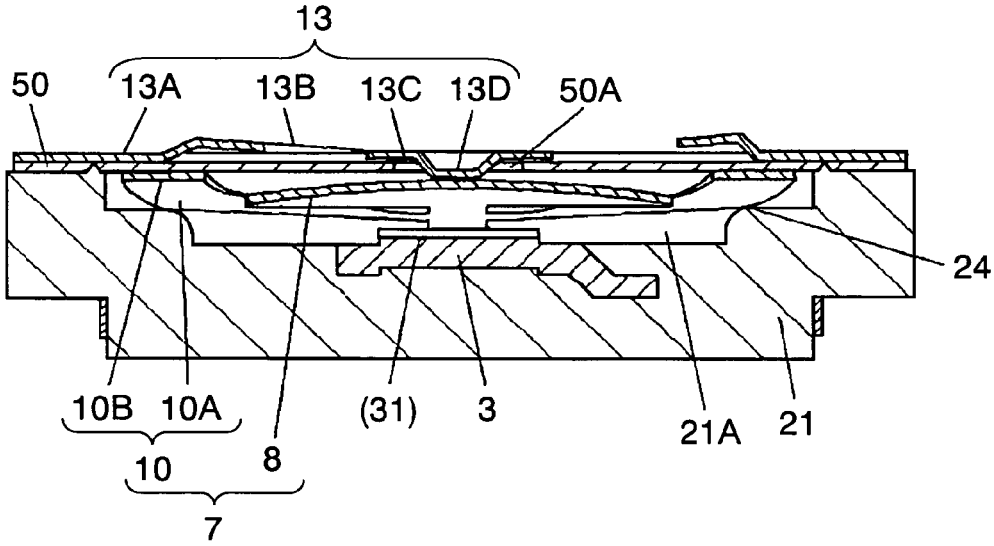
FIG. 6B is a cross-sectional view taken along the line S-S shown in FIG. 3 for explaining the operation of the first-stage switch of the push-on switch according to the invention.

During this state, when a finger is lightly placed on pressing segment 13C of metal cover 13, for example, center pressing segment 13C supported by elastic arms 13B slightly moves downward. Consequently, as shown in FIGS. 6A and 6B, the lower side of downward projection 13D abuts the part of disc segment 8 that corresponds to the position of center through hole 50A of sheet 50. This first-stage action turns a first-stage switch on whereby metal cover 13 and movable contact 7, that is, cover terminal 13E and connection terminal 31A become electrically continuous with each other.

Figure 7:
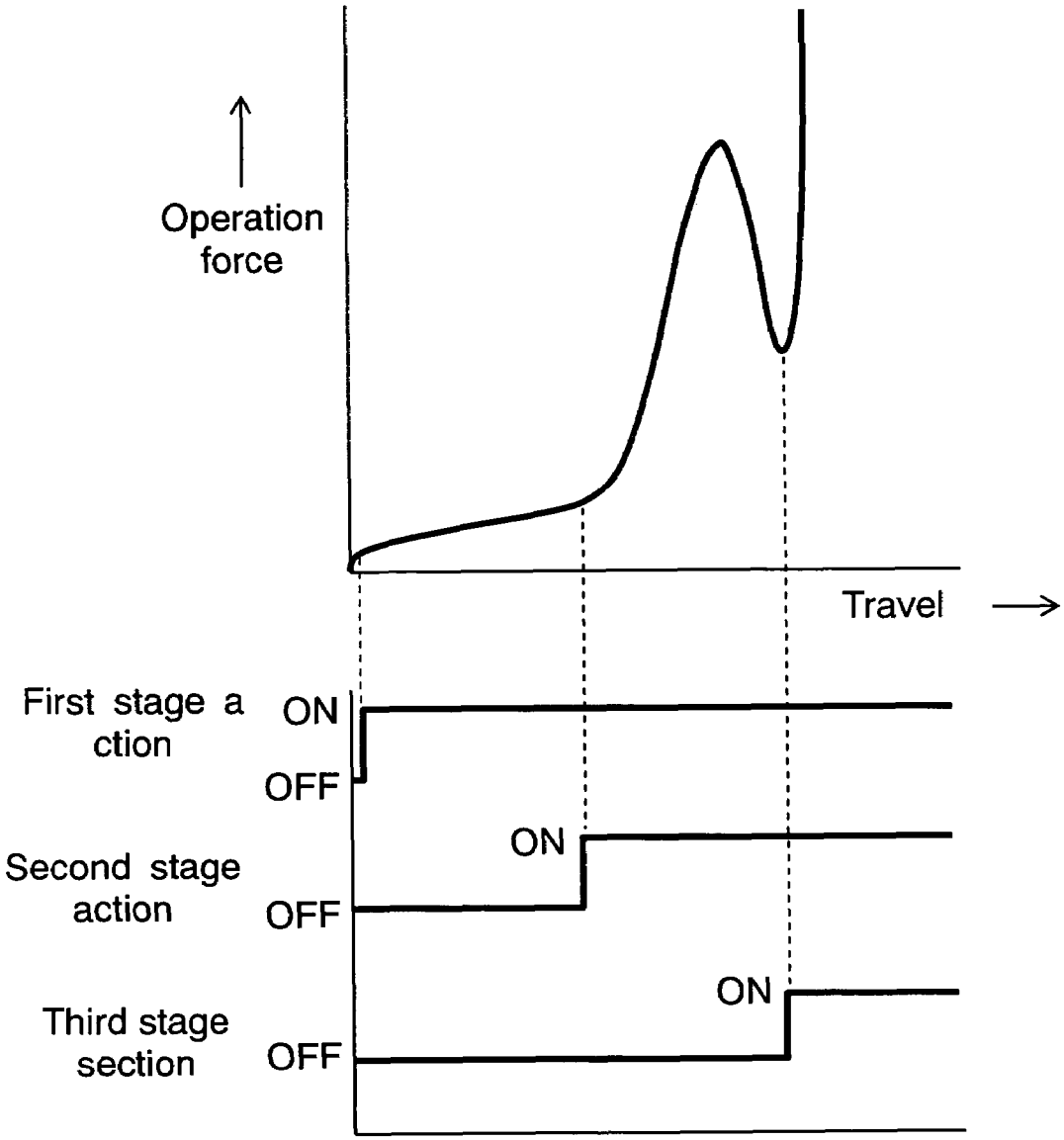
FIG. 7 is a state-transition diagram to show a sequence of the operation of the push-on switch according to the invention.

FIG. 6A is a cross-sectional view taken along the line R-R shown in FIG. 3 for explaining the operation of the first-stage switch. FIG. 6B is a cross-sectional view taken along the line S-S shown in FIG. 3. FIG. 7 collectively shows the relationship between the travel in the operation described above and the timing when the switch at each stage turns on.

As seen from FIG. 7, the first-stage switch can be turned on not only with a very low and weak operation force but also with very short travel. For example, when downward projection 13D of metal cover 13 and the apex of disc segment 8 of movable contact 7 face each other with a vertical gap of 0.05 mm to 0.2 mm therebetween, a downward movement of downward projection 13D corresponding to that gap can turn the first-stage switch on. Pressing segment 13C is preferably configured to prevent an accidental turn-on of the first-stage switch when it is not in operation, for example, due to self-weight bending of pressing segment 13C, by retaining pressing segment 13C at an elevated position lifted by bends disposed at the base parts of elastic arms 13B extending from flat frame-like segment 13A.

In the configuration as described above, by setting the amount of projection of downward projection 13D such that pressing segment 13C will not push sheet 50 downward when the first-stage switch is turned on, the state of the first-stage switch can be changed with a very small force, that is, only the spring tension of elastic arms 13B of metal cover 13. Thus, a force required to move pressing segment 13C during the first-stage action can easily be set to an even smaller value than that conventionally required. Alternatively, the pressing segment of the metal cover may be differently configured from the one described above.

Figure 8A:
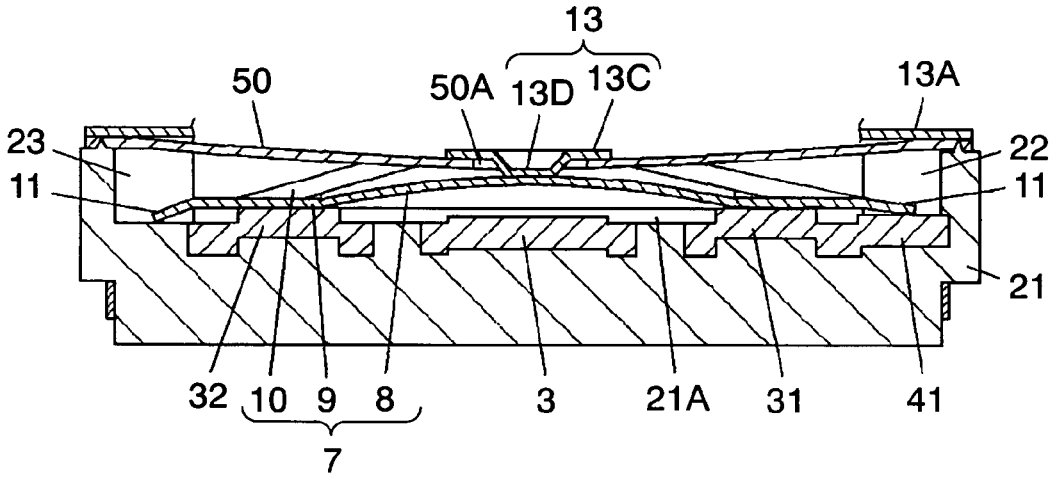
FIG. 8A is a cross-sectional view taken along the line R-R shown in FIG. 3 for explaining the operation of a second-stage switch of the push-on switch according to the invention.
Figure 8B:
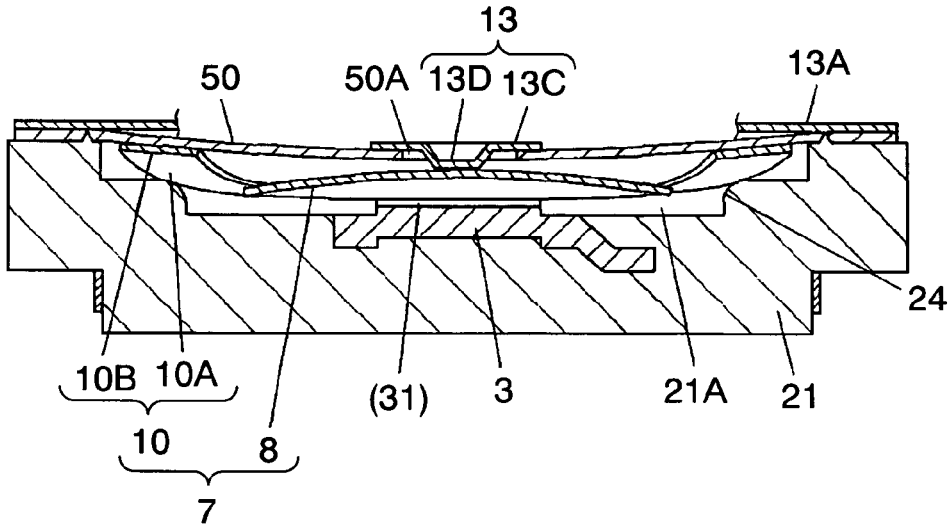
FIG. 8B is a cross-sectional view taken along the line S-S shown in FIG. 3.

Thereafter, when a low pushing force comparative to that in the example of the related art is applied on pressing segment 13C of metal cover 13 in the above state, disc segment 8 of movable contact 7 is further pressed. Then, as shown in FIGS. 8A and 8B, ring segment 10 of movable contact 7, supported by the portions of ring segment 10 placed on movable contact receptacles 24, changes from the convex shape to a concave shape while disc segment 8 keeps its spherical shape. Sheet 50 also bends at center through hole 50A as pressing segment 13C moves downward. This convex-to-concave movement of ring segment 10 causes the disc-side base portions of two connecting segments 9 connecting disc segment 8 and ring segment 10 to come into contact with peripheral contacts 31 and 32, respectively. This second-stage action turns the second-stage switch on whereby connection terminal 32A in addition to cover terminal 13E and connection terminal 31A become electrically continuous with each other.

As peripheral contact 31 and outer contact 41 are electrically continuous with each other in the present configuration, the first-stage switch is always on when the second-stage switch is on. Ring segment 10 may be configured to give a moderate click feeling when it inversely changes its shape. In either case, during and after the above actions, it is preferable to keep the state in which one of projecting segments 11 is permanently in contact with outer contact 41, allowing the second-stage switch to be turned on while the first-stage switch is kept on.

FIG. 8A is a cross-sectional view taken along the line R-R shown in FIG. 3 for explaining the operation of the second-stage switch. FIG. 8B is a cross-sectional view taken along the line S-S shown in FIG. 3. As in the example of the related art, including the following action views, these drawings only show main segments for metal cover 13.

Figure 9A:
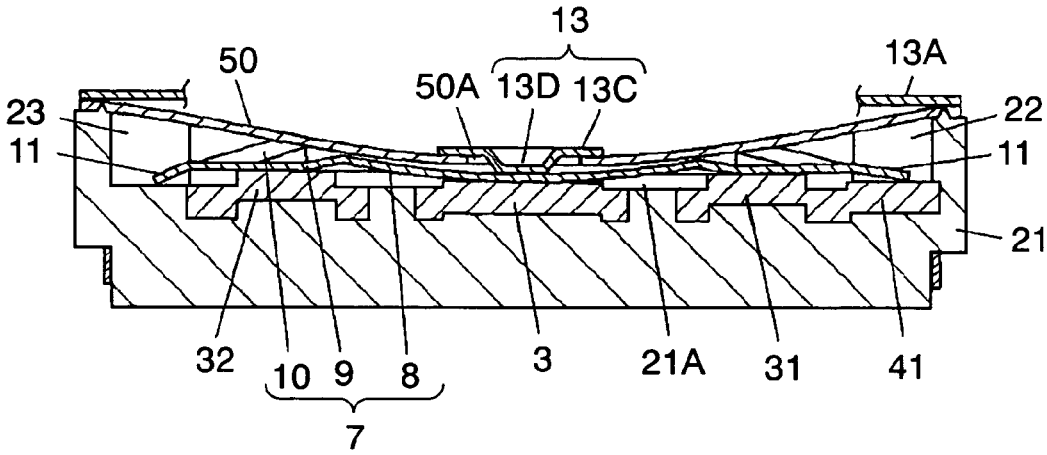
FIG. 9A is a cross-sectional view taken along the line R-R shown in FIG. 3 for explaining the operation of a third-stage switch.
Figure 9B:
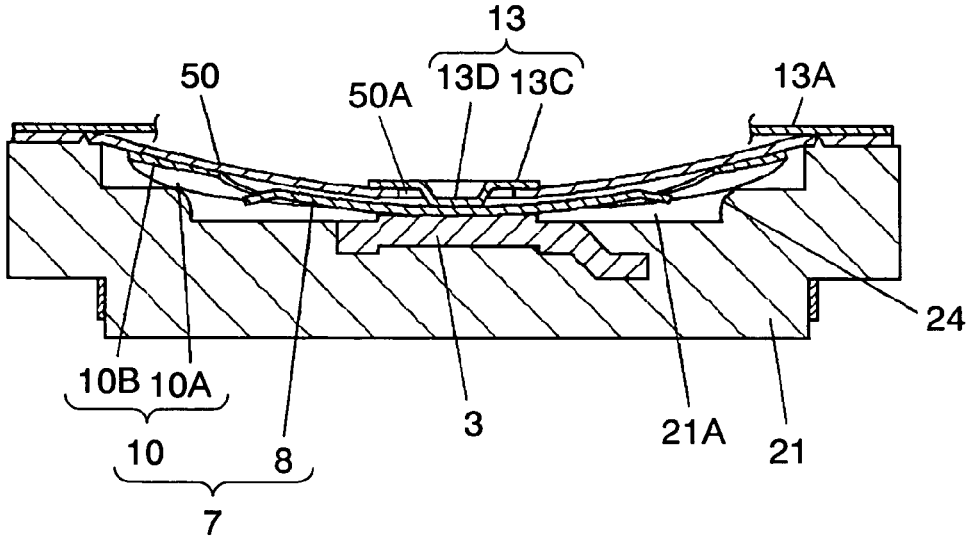
FIG. 9B is a cross-sectional view taken along the line S-S shown in FIG. 3.

When pressing segment 13C is pushed downward and hence downward projection 13D pushes disc segment 8 of movable contact 7 downward, disc segment 8, which is supported by its periphery placed on peripheral contacts 31 and 32, provides moderate click feeling as it changes from the convex shape to a downward concave shape, as shown in FIGS. 9A and 9B. As disc segment 8 moves, sheet 50 is also further pulled at center through hole 50A. The convex-to-concave movement of disc segment 8 causes the center lower side of disc segment 8 to come into contact with center contact 3. This third-stage action turns the third-stage switch on whereby connection terminal 3A of center contact 3 in addition to cover terminal 13E and connection terminals 31A, 32A become electrically continuous with each other via movable contact 7. FIG. 9A is a cross-sectional view taken along the line R-R shown in FIG. 3 for explaining the operation of the third-stage switch. FIG. 9B is a cross-sectional view taken along the line S-S shown in FIG. 3.

As shown in FIGS. 9A and 9B, by employing a configuration in which one of projecting segments 11 is permanently connected with outer contact 41, and the operation of disc segment 8 of movable contact 7 is carried out with the periphery of disc segment 8 supported by peripheral contact 31, which is electrically continuous with outer contact 41, and peripheral contact 32, the third-stage can be switched while the first and second-stage switches are kept on.

To prevent sheet 50 from being displaced to the center side during the above action, low-profile projection 21B on the upper end of switch enclosure 21 preferably surrounds entire recess 21A. In some cases, dual low-profile projections 21B may be provided.

When the pushing force on pressing segment 13C is removed, the pressing force on disc segment 8 of movable contact 7 is removed and disc segment 8 restores its upward protruding spherical shape due to its elastic restoring force. Consequently, the center lower side of disc segment 8 separates from center contact 3 and the third-stage switch returns to its off-state. Substantially at the same time, the connecting segments 9 return to their inclined state in which their disc 8 segment side sections become higher than the other side, and hence the second-stage switch returns to its off-state where peripheral contacts 31 and 32 are electrically isolated. Furthermore, not only is sheet 50 pushed upward and returned to its original position by its own restoring force as well as the restoring motion of movable contact 7, but also the pair of elastic arms 13B extending from flat frame-like portion 13A toward the center return to its non-active upper position. This returns the first-stage switch to its off-state where pressing segment 13C of metal cover 13 is not in contact with movable contact 7.

As described above, the push-on switch according to the invention is a multistage switch in which the first-stage switch can be turned on not only with a very low and weak force, for example, only by placing a finger on the operation section, but also with a short travel.

As the on-state of the first-stage switch can also be retained by only keeping placing the finger on the operation section without having to push it hard with the finger, the on-state is more easily retained than conventionally achievable. During the on-state of the first-stage switch resulting from the light press operation, further operation with a low force turns the second-stage switch on while the first-stage switch is kept on. One further operation provides a moderate click feeling and turns the third-stage switch on.

Applications of the push-on switch according to the invention will be described. It can be applied to shutter release sections of various cameras or record start buttons of video camcorders as in conventional examples.

In these cases, when the push-on switch according to the invention is equipped in a product with an anti-handshake function, the transition to the on-state of the first-stage switch may be used to activate focus adjustment or anti-handshake function, resulting in a user-friendly product.

When the user places a finger on the shutter release button or record start button while pointing the lens at a subject, the first-stage switch turns on without having to even lightly press the button. This will immediately activate focus adjustment or anti-handshake function.

The on-state of the first-stage switch is easily retained by only continuously placing the finger on the operation section, thereby providing better user-friendliness than conventionally achievable. Moreover, if a moderate click feeling is provided when the subsequent light press operation changes the state of the second-stage switch, the user can recognize through the sensation in the finger that a corresponding function is working. Then, as in conventional examples, firmer pressing turns the third-stage switch on, providing a trigger to activate a predetermined function, such as firing the shutter or starting recording.

Even when the push-on switch according to the invention is employed in a configuration in which focus adjustment or anti-handshake function is activated when the second-stage switch is turned on, the problems with the related art can be solved by performing the following operation.

Now, consider a situation in which the user is taking pictures while moving, for example, and the finger slightly comes off the operation section, causing the second-stage switch to turn off. As the first-stage switch of the switch according to the invention is kept on by only placing the finger on the operation section, a configuration in which accidental deactivation of focus adjustment or anti-handshake function will not likely occur can be achieved by activating a timer in an apparatus-side controller after the second-stage switch turns of f in order to keep the focus adjustment or anti-handshake function working except when the first-stage switch turns off in a predetermined period of time.

The push-on switch according to the invention is not limited to camera applications. For example, it may be used in AV/OA products or various remoter controllers.

The push-on switch may also be used as a basis to configure its various derivative products.

Figure 10:
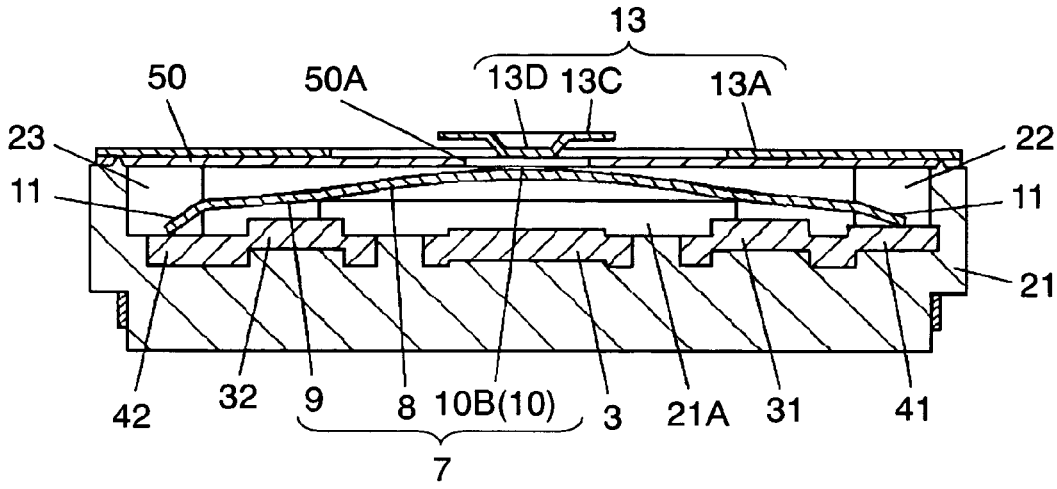
FIG. 10 is a cross-sectional view of another configuration.
Figure 11:
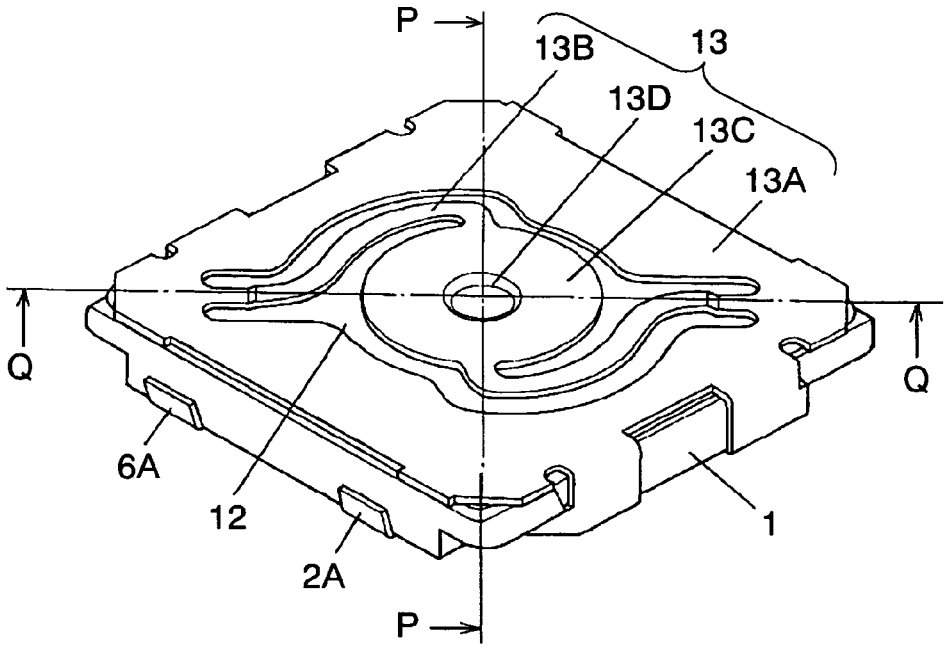
FIG. 11 is an exterior perspective view of a conventional push-on switch.
Figure 12:
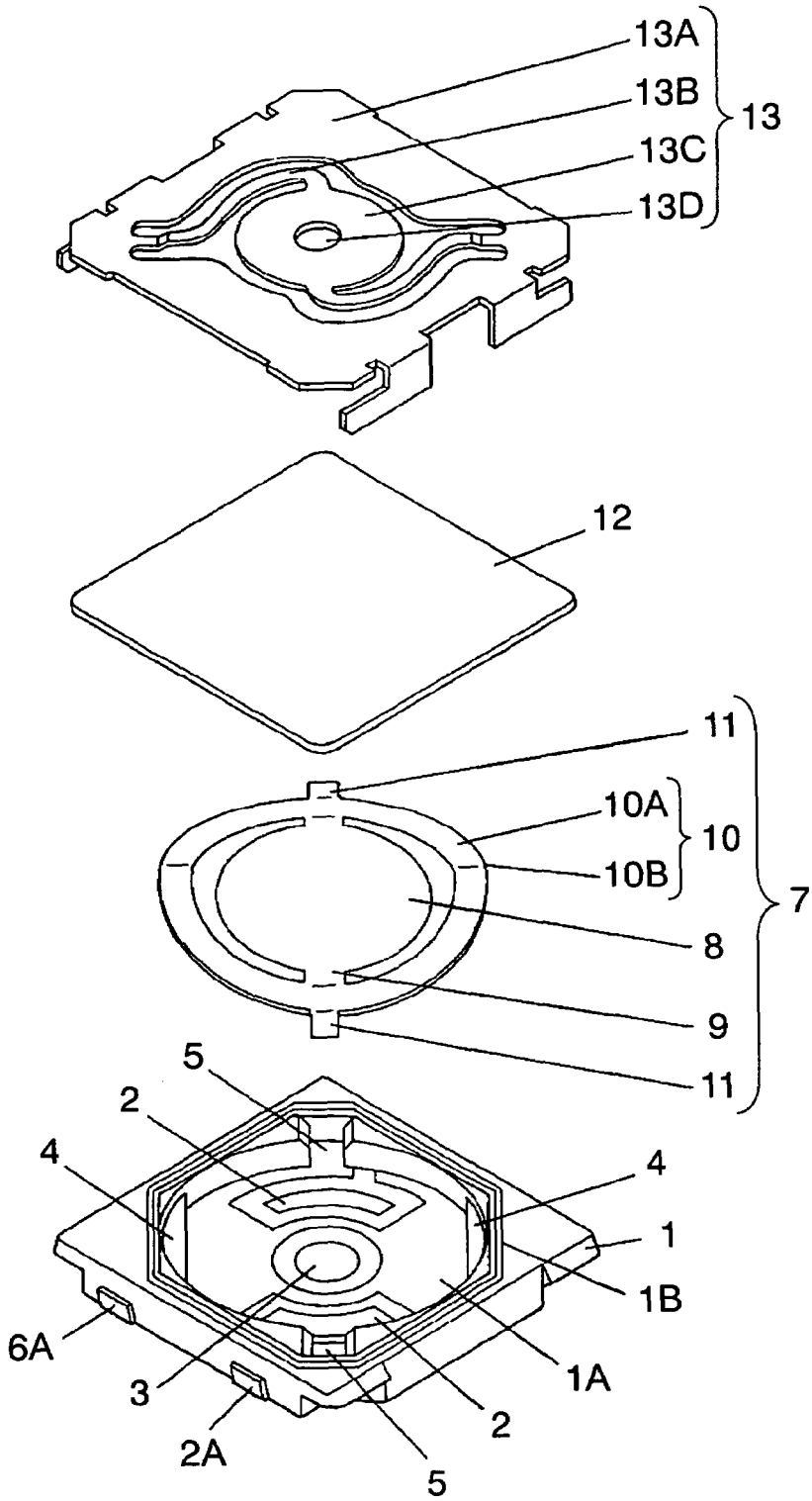
FIG. 12 is an exploded perspective view of the conventional push-on switch of FIG. 11.
Figure 13A:
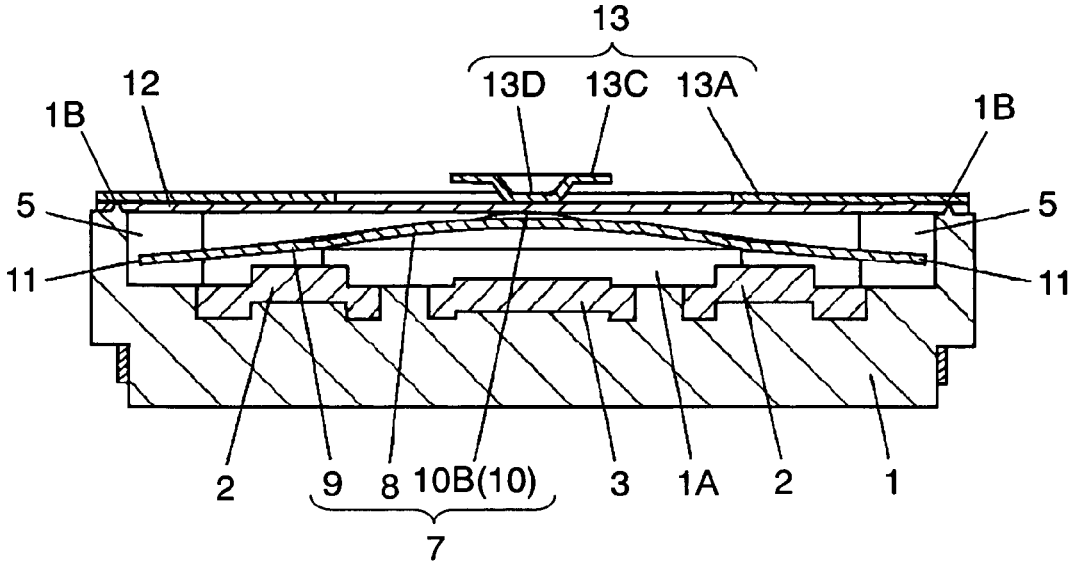
FIG. 13A is a cross-sectional view of the conventional push-on switch taken along the line P-P shown in FIG. 11.
Figure 13B:
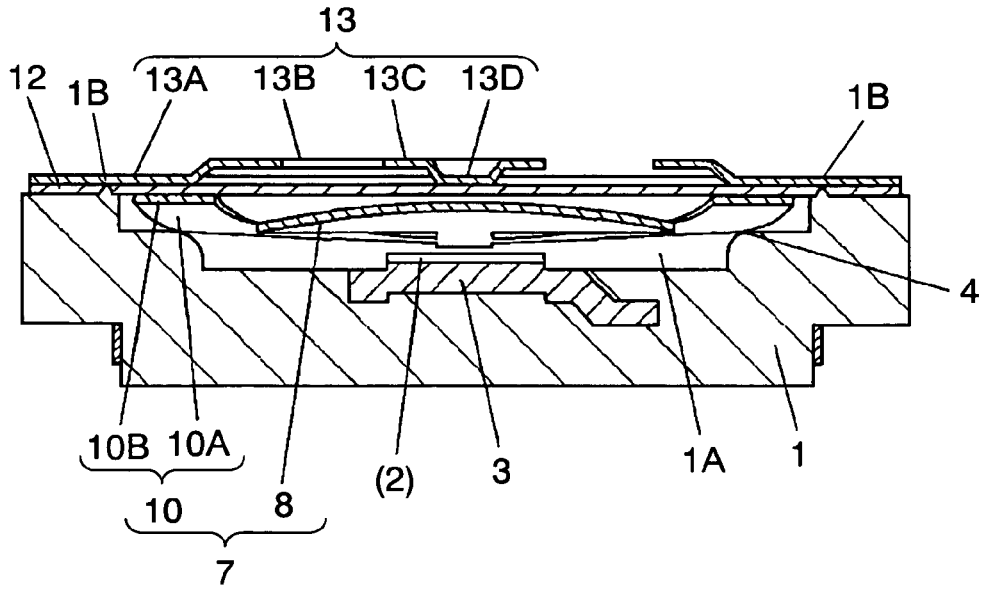
FIG. 13B is a cross-sectional view taken along the line Q-Q shown in FIG. 11.
Figure 14:
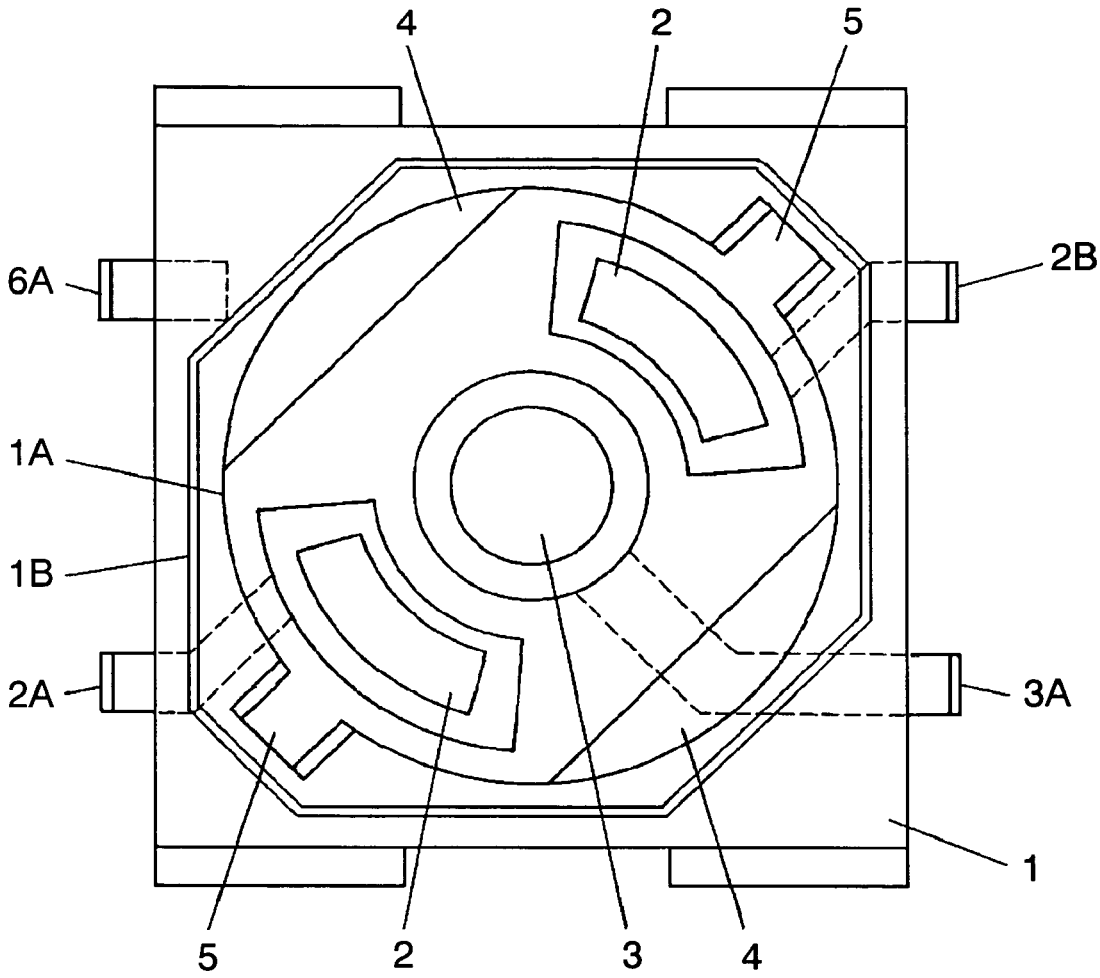
FIG. 14 is a plan view of a switch enclosure of the conventional push-on switch of FIG. 11.
Figure 15A:
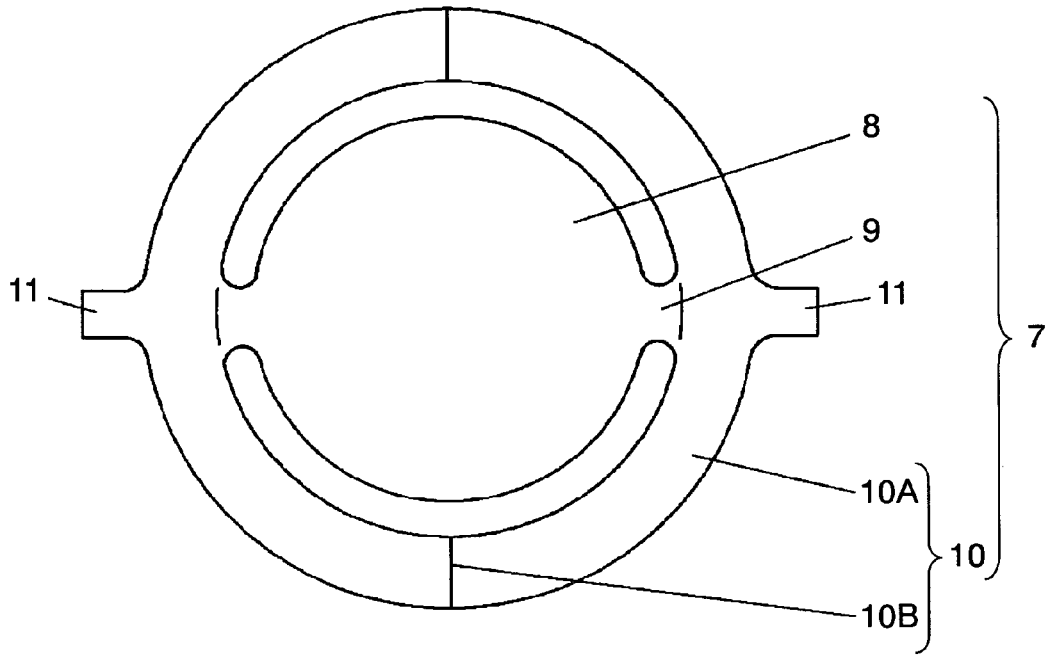
FIG. 15A is a plan view of a movable contact of the conventional push-on switch of FIG. 11.
Figure 15B:
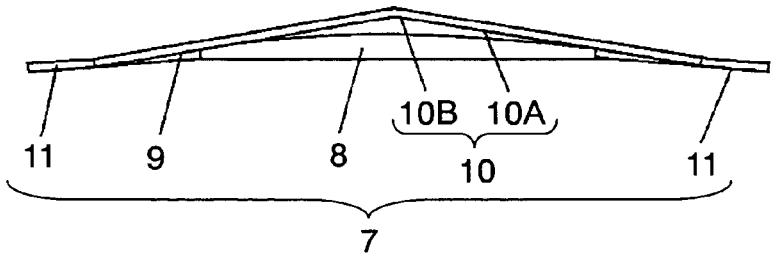
FIG. 15B is a side view of the movable contact of the conventional push-on switch of FIG. 11.
Figure 16:
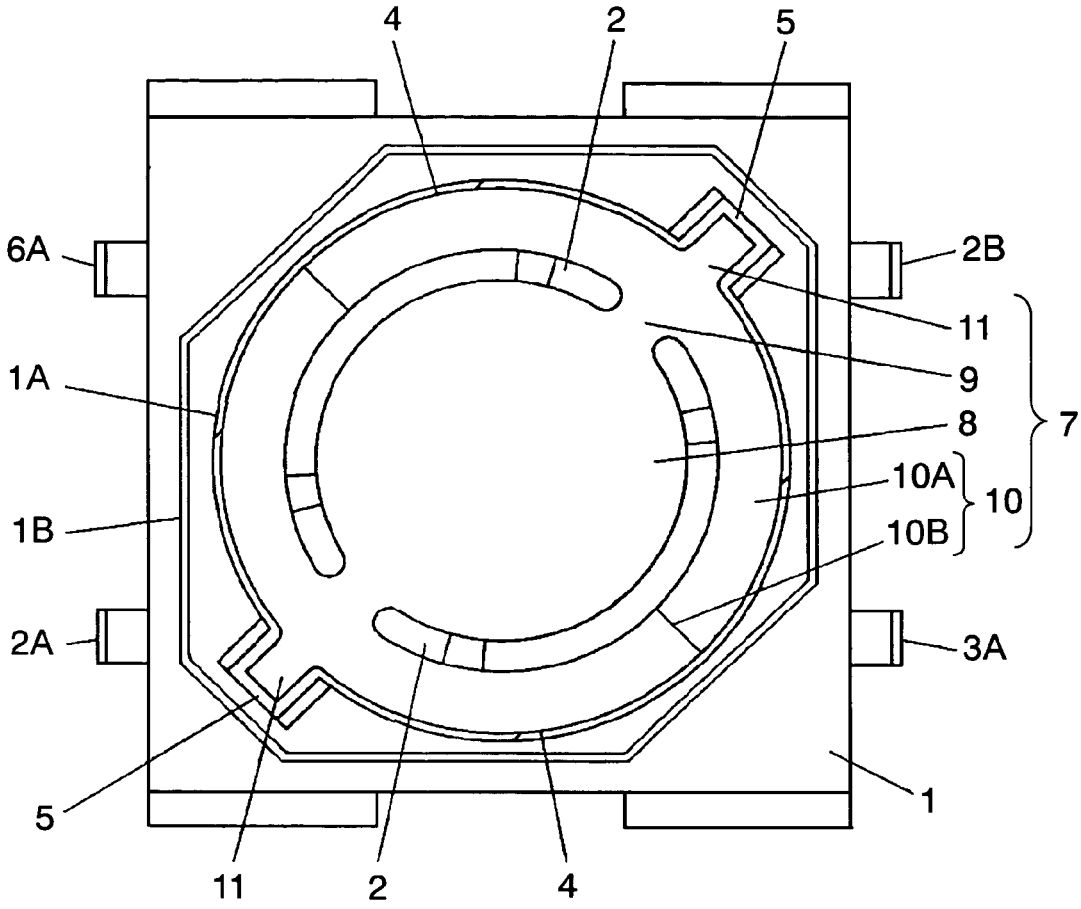
FIG. 16 is a plan view showing the movable contact mounted in the switch enclosure of the conventional push-on switch of FIG. 11.
Figure 17A:
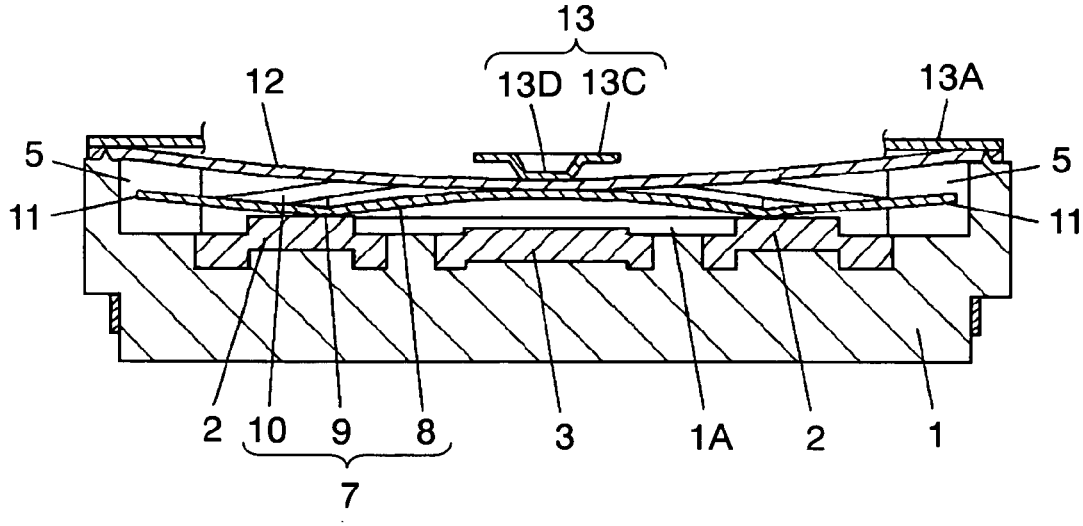
FIG. 17A is a cross-sectional view taken along the line P-P shown in FIG. 11 for explaining the operation of a first-stage switch of the conventional push-on switch.
Figure 17B:
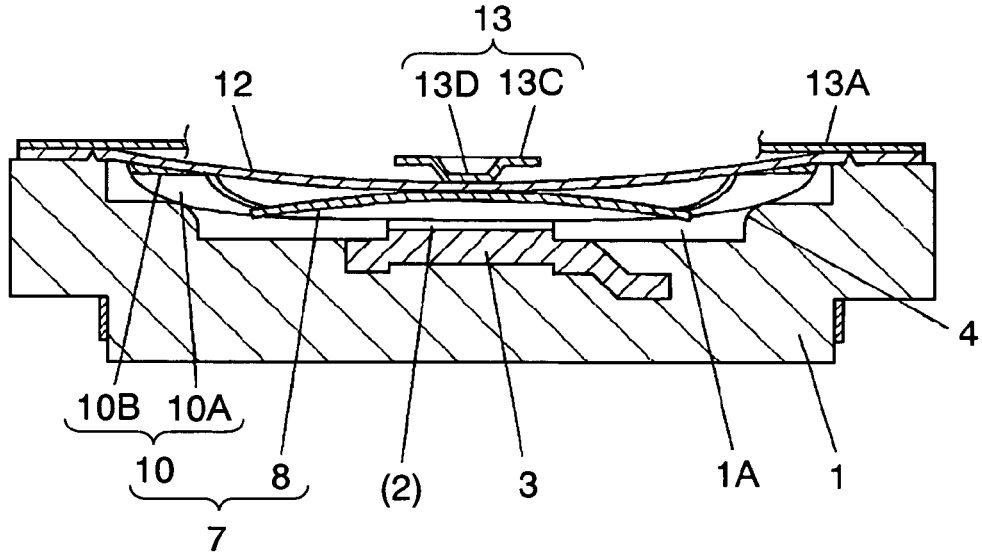
FIG. 17B is a cross-sectional view taken along the line Q-Q shown in FIG. 11.
Figure 18A:
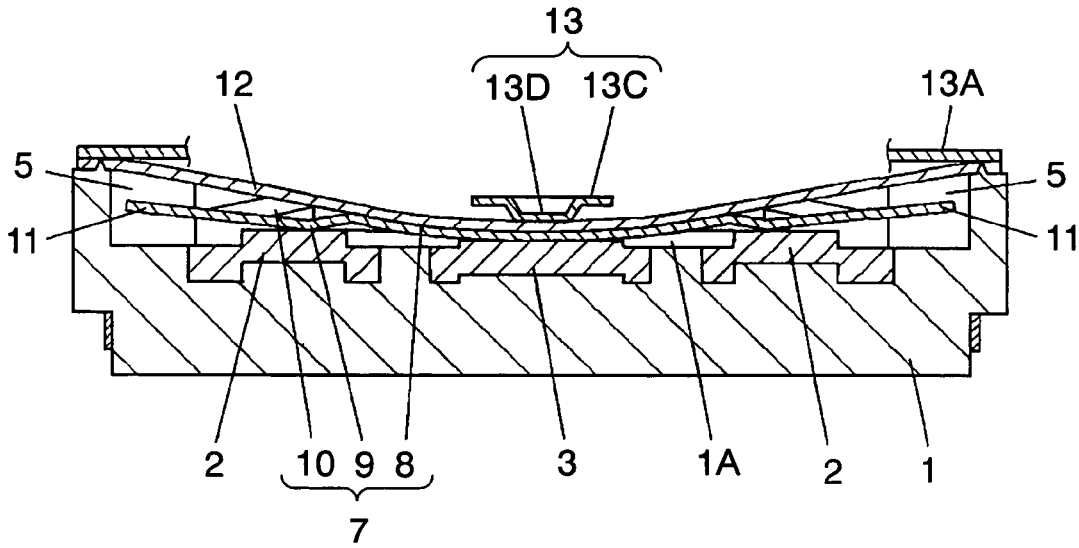
FIG. 18A is a cross-sectional view taken along the line P-P shown in FIG. 11 for explaining the operation of a second-stage switch of the conventional push-on switch.
Figure 18B:
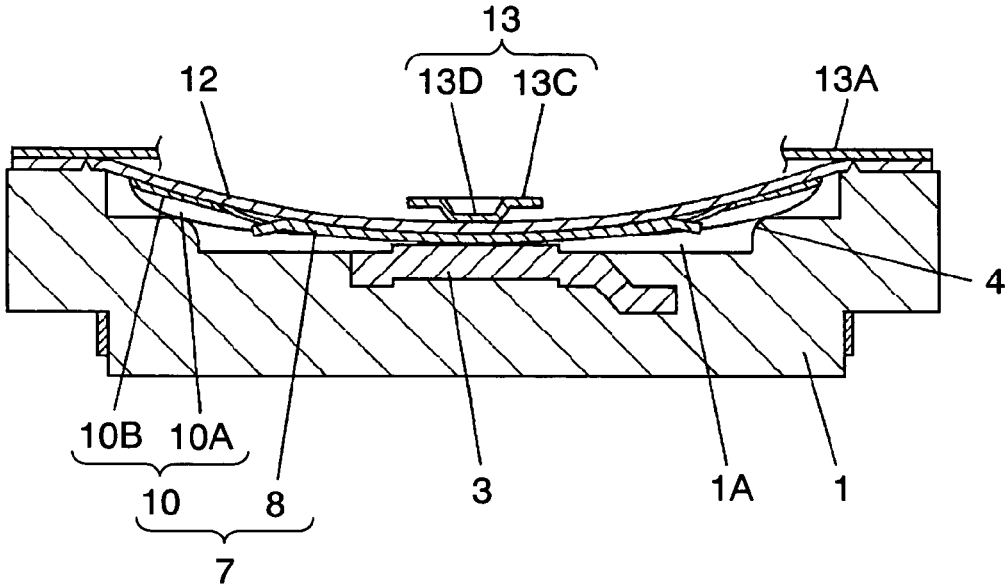
FIG. 18B is a cross-sectional view taken along the line Q-Q shown in FIG. 11.
Figure 19:
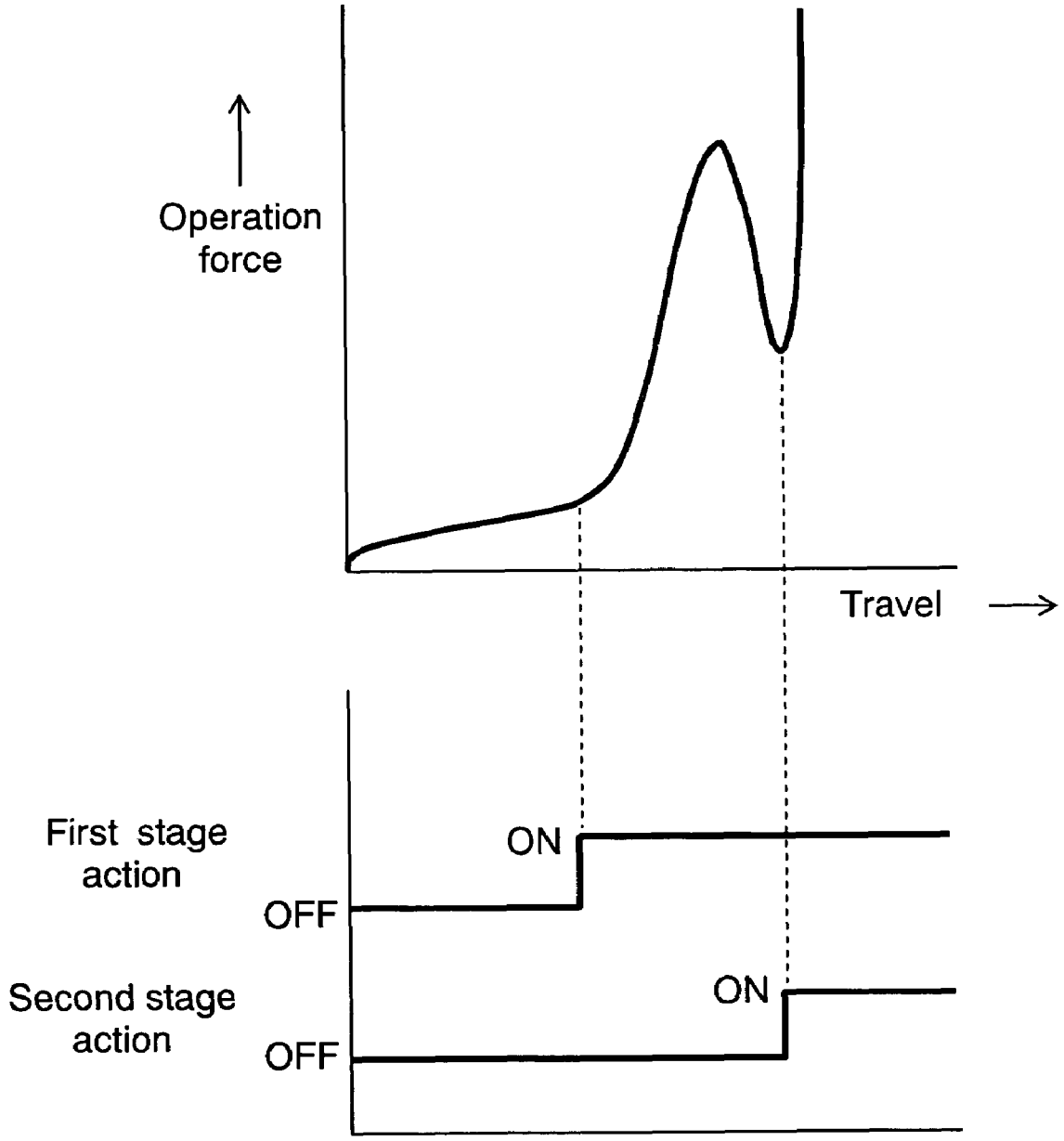
FIG. 19 is a state-transition diagram to show a sequence of the operation of the conventional push-on switch of FIG. 11.

Examples of such derivative products include: a configuration shown in FIG. 10 in which the bottom of cutout groove 23 is formed by outer contact 42 formed of a portion routed from the peripheral contact 32, as in the configuration in which the bottom of cutout groove 22 is provided with outer contact 41; a configuration in which outer contact 42 is permanently connected to the corresponding projecting segment 11; a configuration in which outer contact 42 and the projecting segment 11 face each other with a predetermined gap therebetween; and even a configuration in which a peripheral contact and an outer contact are independently disposed, each provided with a connection terminal.

INDUSTRIAL APPLICABILITY

According to the invention, a multistage push-on switch can be achieved in which the first-stage switch turns on with an operation force lower than conventionally achievable and the resultant on-state is easily retained. Thus, the push-on switch may be easily applied to input operation sections in various electronic apparatuses, providing high industrial applicability.

The invention claimed is:

1. A push-on switch comprising:

a switch enclosure made of insulating resin and having a recess with an inner bottom and an open upper side;

a movable contact disposed in the recess of the switch enclosure;

a sheet disposed to cover the recess of the switch enclosure, the sheet having a center through hole; and a metal cover attached to the switch enclosure, the metal cover having a cover terminal and a pressing segment at a position corresponding to the position of the center through hole of the sheet, the switch enclosure including, on the inner bottom of the recess, a center contact and two peripheral contacts disposed equidistantly therefrom, and at least one outer contact outside the peripheral contacts;

wherein said movable contact includes a disc segment with a spherically curved upper surface and a periphery disposed above the peripheral contacts with a predetermined gap therebetween, an outer ring segment that is concentrically joined with the disc segment by a flexible connecting segment with a fixed distance between the ring segment and the disc segment, the ring segment mounted on a step-shaped movable contact receptacle provided in the recess of the switch enclosure, and a projecting segment that protrudes outward from the ring segment, the projecting segment permanently connected with the outer contact.

2. The push-on switch of claim 1, wherein the outer contact is electrically continuous with one of the peripheral contacts.

3. The push-on switch of claim 1, wherein the lower side of the sheet around the center through hole is adhesively held over a circular ring portion of the disc segment of the movable contact.

* * * * *